United States Patent [19]

Estienne et al.

[11] Patent Number: 4,583,585

[45] Date of Patent: Apr. 22, 1986

[54] SYSTEM FOR CLEANING TUBE-TYPE EXCHANGERS AUTOMATICALLY DURING OPERATION

[75] Inventors: Patrick Estienne, Vernouillet; Michel Sanson, Les Essarts le Roi, both of France

[73] Assignee: Elf France, Courbevoie, France

[21] Appl. No.: 572,124

[22] Filed: Jan. 18, 1984

Related U.S. Application Data

[63] Continuation of Ser. No. 285,783, Jul. 22, 1981, abandoned.

[51] Int. Cl.[4] ..... F28G 1/12; F28G 3/08

[52] U.S. Cl. ..... 165/94; 165/95; 122/379; 15/104.05; 134/8

[58] Field of Search ..... 138/38; 122/379; 15/104.05, 104.03, 104.09, 104.16; 134/8, 22.11; 62/303; 137/242

[56] References Cited

U.S. PATENT DOCUMENTS

| | | | |
|---|---|---|---|
| 810,632 | 1/1906 | Faherty et al. | 122/379 |
| 3,648,754 | 3/1972 | Sephton | 138/38 |
| 3,800,182 | 3/1974 | Wilczek | 138/38 |
| 4,174,750 | 11/1979 | Nichols | 165/85 |
| 4,315,541 | 2/1982 | Murata et al. | 165/109 R |

FOREIGN PATENT DOCUMENTS

| | | | |
|---|---|---|---|
| 0457572 | 3/1928 | Fed. Rep. of Germany | 165/134 R |
| 0469167 | 7/1914 | France | 138/38 |
| 0628472 | 11/1961 | Italy | 165/95 |
| 0028471 | 2/1980 | Japan | 138/38 |
| 0006845 | of 1900 | United Kingdom | 138/38 |
| 0196256 | 1/1924 | United Kingdom | 138/38 |
| 0608048 | 4/1978 | U.S.S.R. | 165/95 |
| 0705239 | 1/1980 | U.S.S.R. | 138/38 |

*Primary Examiner*—William R. Cline
*Assistant Examiner*—John K. Ford
*Attorney, Agent, or Firm*—Burgess, Ryan & Wayne

[57] ABSTRACT

A device for cleaning the tubes of tube-type heat exchangers and/or preventing the accumulation of deposits therein, the device consisting of a helix of a material which is resistant to corrosion and abrasion, which can be constantly agitated and thus repeatedly brought into contact with the internal walls of the tubes under the effect of the fluid stream the helix being held in position against longitudinal movement by a hooking means disposed at the upstream end of the helix which means permits the rotation of the helix within the tube. Use of said device for the automatic cleaning of tube-type heat exchangers.

4 Claims, 3 Drawing Figures

SYSTEM FOR CLEANING TUBE-TYPE EXCHANGERS AUTOMATICALLY DURING OPERATION

This application is a continuation of application Ser. No. 285,783, filed July 22, 1981 now abandoned.

The invention relates to a device for cleaning tube-type heat exchangers automatically during operation. It also relates to tube-type heat exchangers including such a device.

The accumulation of dirt and the like in a heat exchanger, for example in oil refineries, entails various drawbacks, such as:

- a progressive fall in thermal exchange performance, giving rise to a greater consumption of energy;
- a progressive increase in the loss of pressure, and sometimes a limitation on throughput,
- the necessity of stopping a plant in order to clean one of its exchangers if it is not fitted with a bypass, which involves a production loss which has to be made up and various expenses inherent in all stopping and restarting operations, such as the expense of fuel, flaring, etc.

Investment in the provision of a bypass involves other expenses, e.g. those of installing isolating valves for the bypass and its valve, as well as those related to the loss of heat during the period when the bypassed exchanger is being cleaned.

In any case, the cleaning of the assembly of heat exchanger tubes is laborious and the dirty tubes are sometimes found to be corroded under the deposit of dirt.

The subject of the invention is a simple, relatively inexpensive device for providing permanent automatic cleaning of the inside of tubes when the exchanger is in use. This device is placed in each tube in the apparatus.

SUMMARY OF THE INVENTION

The invention relates to a device for cleaning tube-type heat exchangers provided with a tube assembly through which a fluid is to flow and containing a device for cleaning the tube and/or preventing the accumulation of deposits therein, the said device consisting of a helix of a material which is resistant to corrosion and abrasion, which can be constantly agitated and thus repeatedly brought into contact with the internal walls of the tubes under the effect of the fluid stream the helix being held in position against longitudinal movement by a hooking means disposed at the upstream end of the helix, which permits rotation of the helix within the tube.

According to another aspect of the invention there is provided a device for installation within a tube through which a fluid is to flow to clean the tube or prevent the accumulation of deposits within the tube, the device comprising a helix of corrosion and abrasion resistant wire having means enabling it to be attached to the tube to prevent longitudinal movement but to allow rotation, relative to the tube.

According to a first embodiment, a metal wire in an elongated spiral shape, having a specific pitch varying from 1 to 7 times the diameter of the tube and possibly obtained by stretching a helical spring, is threaded by suction, for example, into a slightly longer tube, to allow for the lengthening of the helical wire during use.

The helix is formed from a metal wire with a diameter of from 0.3 to 1 mm which is resistant to corrosion and abrasion, such as a spring wire made of a suitable metal or alloy such as cold-rolled titanium for example, or any other suitable material. The choice of the characteristics of the helix—its pitch, diameter, elasticity, the diameter of the wire from which the helix is formed, and the construction material—is basically determined by the vibration frequency desired under the operating conditions of the exchanger.

The elongated helix is bounded by an imaginary cylinder with a diameter which is equal to at least half the diameter of the tube, and it is preferably bounded by an imaginary cylinder with a diameter of between 0.50 and 0.90 times the internal diameter of the tube.

The helix is fixed in the tube in a flexible manner by one of its ends, on the upstream side relative to the flow of fluid, via a hooking system which may be of the same kind as the spring, or of a different kind. Thus this hooking system may be an inserted part, such as a metal hook in the shape of a "u" made of the same material as the spring or any other material which is resistant to corrosion and abrasion. Again, it may be formed by the interlocking connection of the ends of two adjacent wires.

Under the effect of a turbulent stream of fluid, the helix is permanently agitated; it regularly strikes and rubs all the points of the internal wall of the tube as it turns, thus providing repeated contact with the internal wall. A variation in the throughput of the conducted fluid brings about a variation in the length of the arrangement and consequently changes the striking and rubbing points on the interior of the tube.

The invention also relates to tube-type heat exchangers including a device such as described above.

BRIEF DESCRIPTION OF THE DRAWINGS

The invention is illustrated by the following drawings and Examples which are given as an indication, but are not limitative.

DETAILED DESCRIPTION OF PREFERRED EMBODIMENTS

EXAMPLE 1

Figure 2:
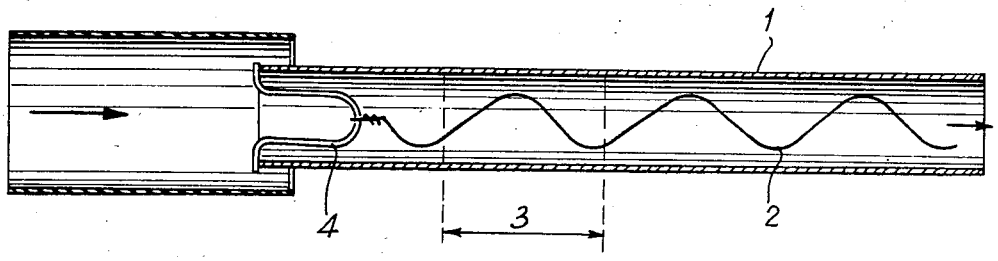
FIG. 2 shows a section through the layout of the laboratory test arrangement.
Figure 3:
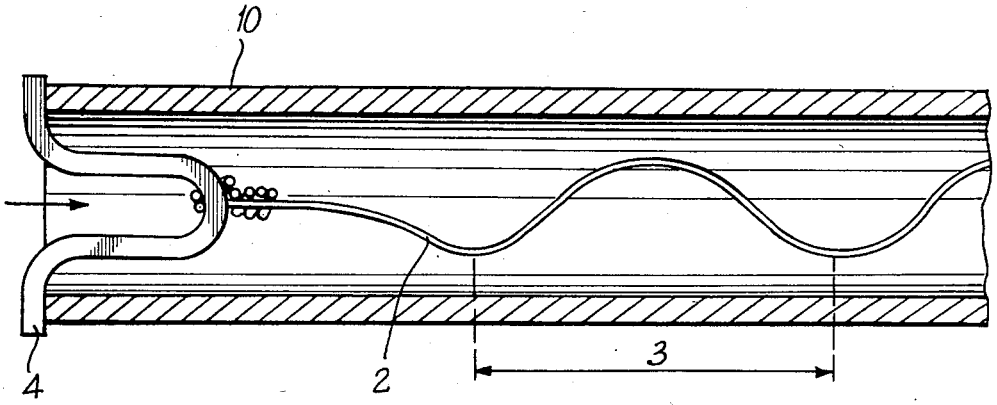
FIG. 3 is a schematic section through a heat exchanger in a plant.

As shown in FIG. 2, the test was carried out in the laboratory on a glass tube 1 with an internal diameter of 15 mm. The helix 2 is formed from a titanium wire with a diameter of 0.5 mm to avoid any risk of corrosion in use. The pitch of the helix is 30 mm.

The diameter of the helix is 11 mm, and it is attached by a hook 4 to the upstream end of the tube.

The fluid chosen is water, so as to enable the behaviour of the stretched spring to be observed in a transparent medium, and it is circulating in the direction indicated by the arrows.

It was thus possible to confirm that at a flow speed of 20 l/minute, analogous to that of the crude oil in the tubes of a specific heat exchanger which regularly becomes soiled, the metal wire is endowed with a permanent agitation motion which brings it into contact with the walls of the tube.

EXAMPLE 2

Figure 1:
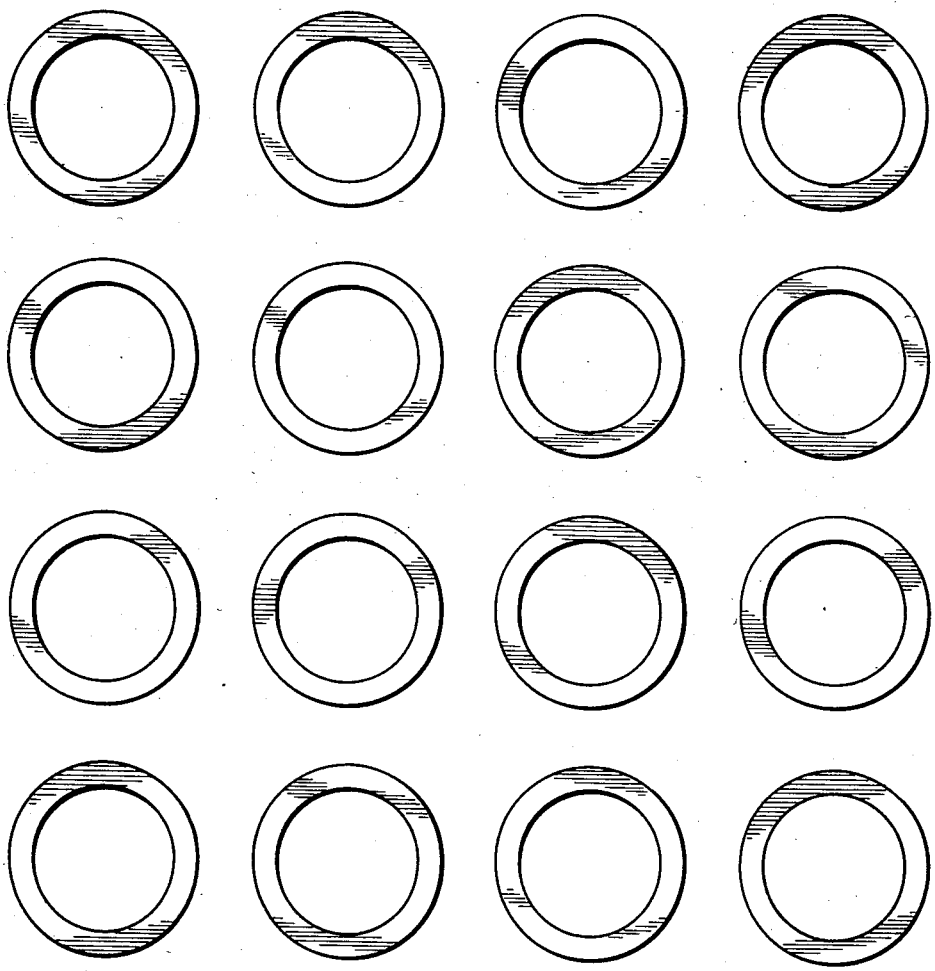
FIG. 1 shows part of a plate in which the heat exchanger tubes are inserted, shown by their cross-section.

An industrial test on a hundred tubes 10 arranged as shown in FIG. 1, with an internal diameter of 15 mm, was carried out with a spiralled titanium wire with a diameter of 0.5 mm. The diameter of the helix was 8 mm, and its pitch was 30 mm. These wires were attached at one end either by a hook or by twisting them together in pairs. The crude petroleum circulates at a flow speed of approximately 0.40 m/sec in the tubes.

After operating for approximately 240 days, some of the tubes equipped with helical wires and some other tubes which were not so equipped were removed.

After having cut a certain number of these tubes in half lengthwise, it was possible to observe that the tubes which were equipped with a helix displayed on a clean internal wall, while the other tubes were soiled internally.

EXAMPLE 3

An industrial test on a complete heat exchanger with 2 sets of tubes with an internal diameter of 15 mm was carried out with helical titanium wire with a wire diameter of 0.6 mm, a helix diameter of 8 mm and a pitch of 30 mm. These wires were attached at the end where the petroleum enters, by a hook, also made of titanium. The crude petroleum circulates in the tubes at a flow speed of approximately 0.40 m/sec.

After an operating time of approximately 140 days, the soiling in the tubes of this exchanger was compared with that in an identical exchanger with the same use. The tubes of the exchanger which was not equipped displayed marked internal soiling. A series of comparative measurements of the levels of heat transfer of these two exchangers shows the advantage of the helical device.

It was confirmed that the thermal exchanger equipped with the automatic cleaning device according to the invention maintained its thermal performance, while the exchanger without the arrangement displayed a progressive soiling.

The device according to the invention therefore makes it possible to avoid the loss of calorific energy and to maintain a maximum and constant level of thermal transfer over a period of time. Another economic advantage is afforded by the fact that the price of supplying and fitting the device is of the same order of magnitude as the cost of cleaning the exchanger, and the investment may be recouped very rapidly by savings in energy and the elimination of cleaning costs.

What is claimed is:

1. In a tube-type assembly comprising a tubular member wherein a fluid stream may flow from an upstream end towards a downstream end of said member, a device for cleaning the inner surface of said member, said device consisting essentially of:

support means extending to the axis of said tubular member adjacent the upstream end thereof and which is non-movable along the axis of said tubular member; and a corrosion-resistant and abrasion-resistant resilient metal wire having an elongated spiral shape having at least one end fixedly engaging said support means at the axis of said tubular member, said metal wire elongated spiral being disposed within said approximately coaxial with said tubular member, said elongated spiral having an outer diameter substantially greater than the diameter of the wire comprising the elongated spiral and in the range of 0.5 to 0.9 times the inner diameter of said tubular member, the distance between successive loops of said elongated spiral being substantially greater than the diameter of said wire, whereby said metal wire elongated spiral is sufficiently flexible such that said fluid stream causes said spiral to rotate and said wire to strike and rub against the inner surface of said tubular member to clean said inner surface.

2. The device according to claim 1, wherein the distance between successive loops of said elongated spiral is in the range of 1 to 7 times the inner diameter of said tubular member.

3. The device according to claim 1, wherein said support means comprises a U-shaped hook.

4. The device according to claim 1, wherein said support means comprises cold-rolled titanium.

* * * * *